US006003823A

United States Patent [19]

Hoffman

[11] Patent Number: 6,003,823

[45] Date of Patent: Dec. 21, 1999

[54] PLATFORM APPARATUS FOR SUPPORT STANDS

[76] Inventor: William Hoffman, 162 Colon St., Beverly, Mass. 01915-3633

[21] Appl. No.: 08/987,374

[22] Filed: Dec. 9, 1997

[51] Int. Cl.[6] ..... F16M 11/00

[52] U.S. Cl. ..... 248/163.2; 248/177.1

[58] Field of Search ..... 248/163.1, 371, 248/415, 432, 177.1, 354.1, 354.2, 354.3, 354.4, 354.5, 146, 149, 127, 163.2; 405/3, 4, 7

[56] References Cited

U.S. PATENT DOCUMENTS

| | | | |
|---|---|---|---|
| 1,334,662 | 3/1920 | MacLeod . | |
| 2,805,902 | 9/1957 | Drasek et al. . | |
| 3,419,108 | 12/1968 | Mobbs . | |
| 4,155,667 | 5/1979 | Ebsen . | |
| 4,339,880 | 7/1982 | Hall | 248/163.1 |
| 4,598,795 | 7/1986 | Larson . | |
| 4,756,642 | 7/1988 | Quinn et al. | 405/3 |
| 4,759,660 | 7/1988 | Corbett . | |
| 4,934,486 | 6/1990 | Butler et al. . | |
| 5,290,124 | 3/1994 | Pavlescak | 405/3 |
| 5,374,156 | 12/1994 | Simpson et al. | 405/3 |
| 5,503,358 | 4/1996 | Lapp . | |

FOREIGN PATENT DOCUMENTS

| | | |
|---|---|---|
| 7195 | 5/1927 | Australia . |

*Primary Examiner*—Ramon O. Ramirez

*Attorney, Agent, or Firm*—Watson Cole Grindle Watson, P.L.L.C.

[57] ABSTRACT

A platform adaptor for attachment to a support stand for supporting a large object such as a boat at dry dock includes a support beam which is pivotally connected to a center pole of the support stand and two support struts which extend downwardly from the support beam to attachment to two legs of the support stand such that the support beam will be generally horizontally oriented. A platform plank can be positioned on support beams of two platform adaptors attached to two spaced apart support stands to provide a platform for people and equipment located adjacent the supported object.

14 Claims, 3 Drawing Sheets

50
31
33
32
40
30
35

43

38
39
16
33
34
35
31
14
37
36
41

35

33

34
33
34

PLATFORM APPARATUS FOR SUPPORT STANDS

BACKGROUND OF THE INVENTION

1. Field of the Invention

This invention relates to support stands for supporting large objects such as boats at dry dock, and in particular to a platform apparatus that is attachable to such support stands to provide a platform adjacent the supported object for people and equipment.

2. The Prior Art

Support stands for use in supporting and stabilizing large objects are well known and of varying sizes and complexity. One category of support stands are adapted to contact the hull of a boat at dry dock so as to maintain the upright orientation of the boat for storage or repair. Often times multiple support stands are located in spaced relation along both sides of the hull. Typical support stands of this type include a center pole supported by three legs, one of the legs being shorter in length than the other two, with the center pole mounting an abutment element which can be moved in relation to the center pole so as to contact and buttress the hull against tilting. See, for example, U.S. Pat. No. 4,155,667 and U.S. Pat. No. 4,759,660.

When repair work needs to be done on the hull, workers must use ladders to elevate themselves to the necessary heights or scaffolding must be erected next to the boat. Using ladders is not always adequate as there will be no place to put heavy equipment that may be needed, and the erection of scaffolding requires the availability of extra equipment that may be expensive and complicated to put together.

SUMMARY OF THE INVENTION

It is an object of the present invention to provide platform apparatus for support stands that is simple in construction and easy to erect.

This object is achieved by a platform adaptor which includes a support beam that is attachable at one end to the center pole of a typical support stand, and two support struts that extend downwardly from the support beam for attachment to two of the legs of the support stand. Two of these platform adaptors connected to two spaced apart support stands can then support a platform element or plank that will extend along the side of the object being supported so that persons and equipment can be located on the platform element at the desired height above the ground (or flooring surface). The platform adaptors are simple in construction, easy to store and inexpensive to make.

The invention will be better understood by reference to the attached drawings taken in conjunction with the following discussion.

DETAILED DESCRIPTION OF THE PREFERRED EMBODIMENTS

Figure 1:
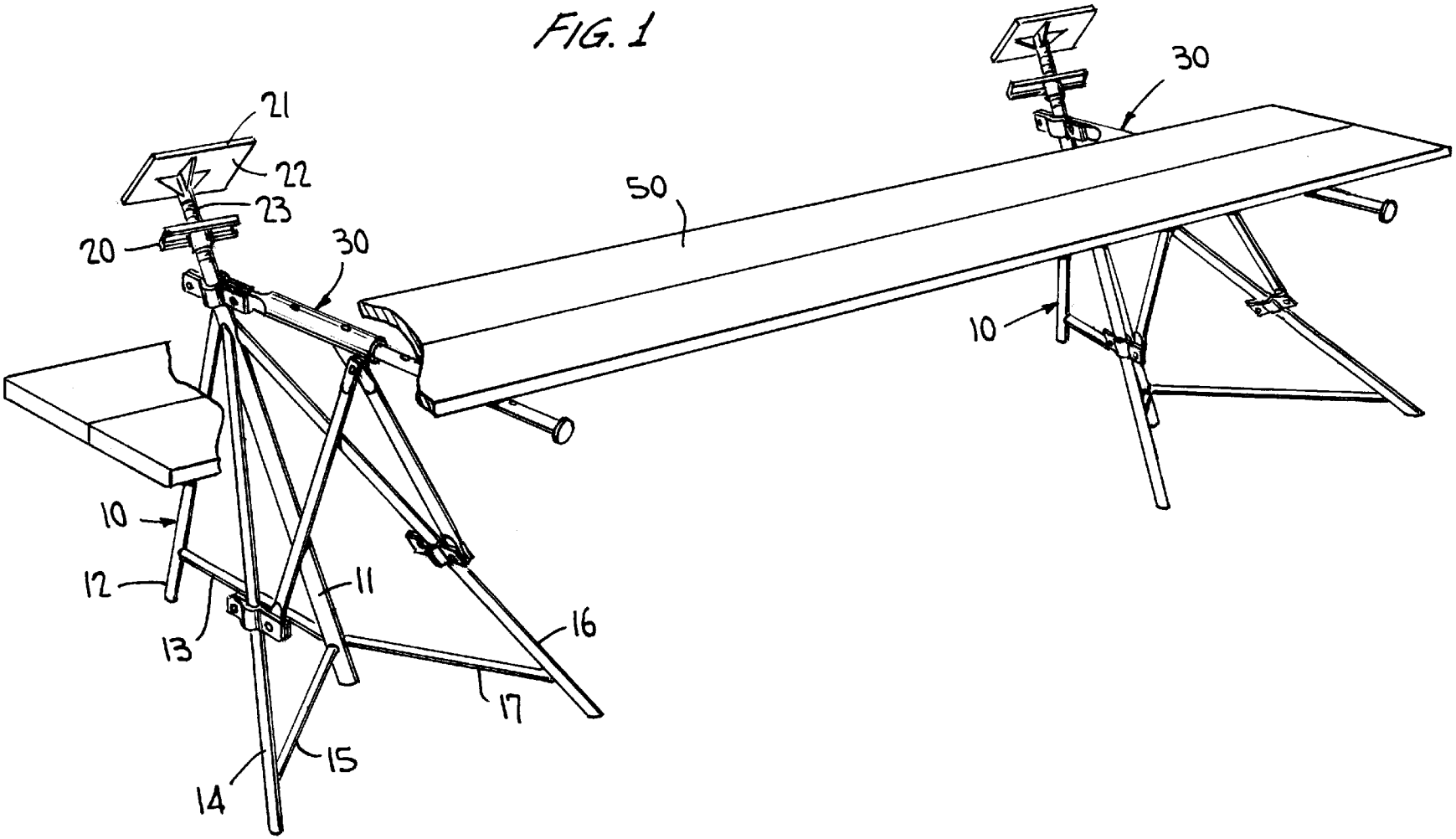
FIG. 1 is a perspective view of two spaced-apart support stands, each having a first preferred embodiment of platform adapter according to the present invention attached thereto for supporting a horizontal platform element laterally of a supported object.

When a boat is dry docked for repairs or storage, it can be maintained in an upright orientation by positioning two or more support stands along each side so that a support element of each support stand will contact and support (buttress) the hull. FIG. 1 shows two spaced-apart support stands 10 positioned to contact and support a hull of a boat (not shown). Each support stand includes a center pole 11 which is positioned above a flooring or ground surface by three legs 12, 14, 16 that are connected at their upper ends to the center pole and spaced at their lower ends from the center pole by spacer bars 13, 15, 17. The leg 12 is shorter in length than legs 14 and 16 so that the center pole 11 will tilt at an acute angle relative to vertical (see FIG. 2) and toward the boat hull. Located at the upper end of the center pole 10 is an adjusting collar 20 having a threaded bore therethrough, as well as an abutment element 21 including a contact plate 22 and a screw element 23 extending away from an underside of the contact plate 22, the screw element threadingly passing through the threaded bore in the adjusting collar 20 and into the upper end of the center pole 11. The contact plate 22 is adjustably movable relative to a hull of an adjacent boat by rotational movement of the adjusting collar 20, causing the screw element 23 to move out of or into the upper end of the center pole. In this way, the contact plate 22 can be extended away from the center pole 11 and into contact with the adjacent boat hull.

Figure 2:
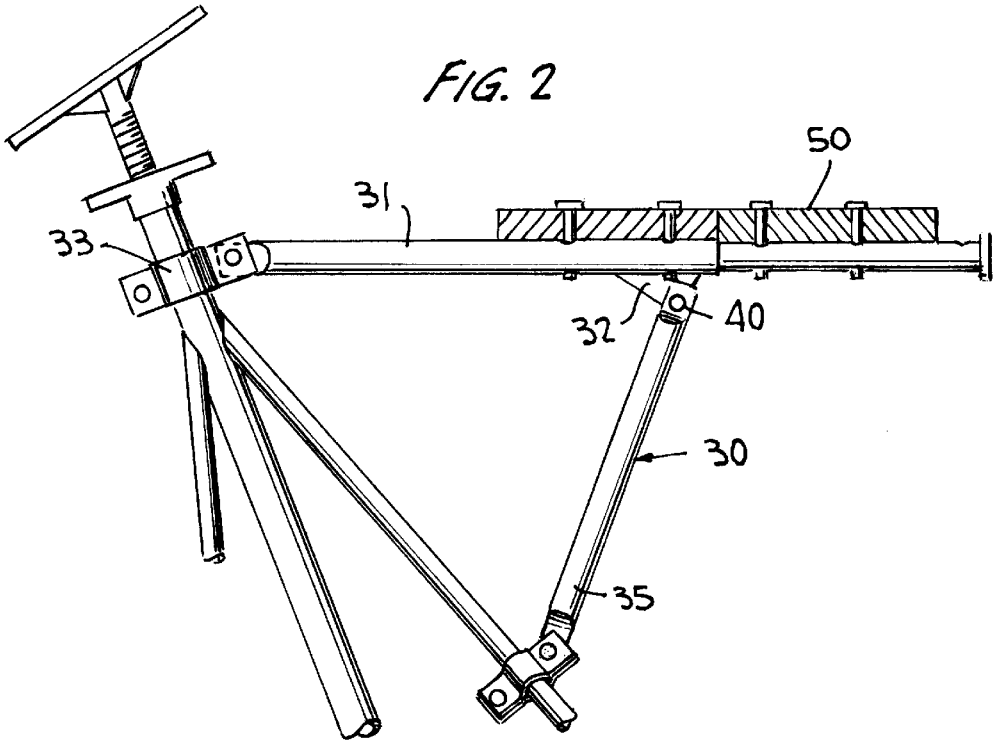
FIG. 2 is a side view of one of the two platform adaptors of FIG. 1 and a portion of the support stand to which it is attached.
Figure 3:
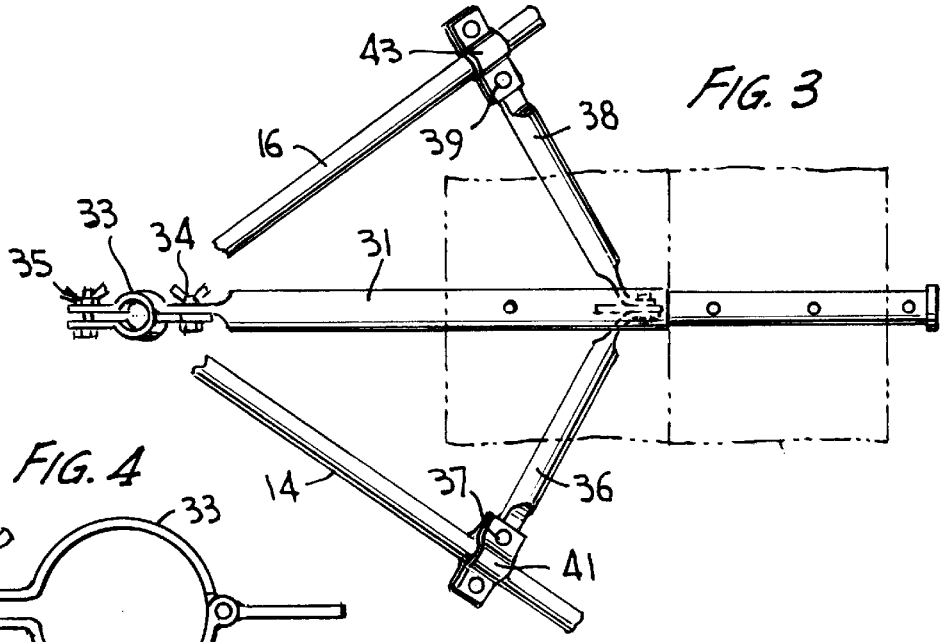
FIG. 3 is a top plan view of platform adaptor shown in FIG. 2.
Figure 4:
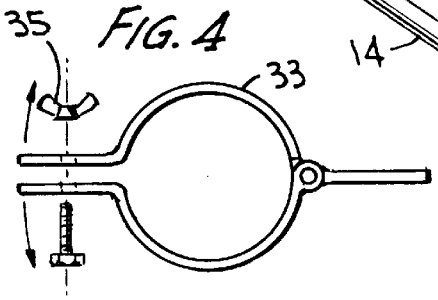
FIG. 4 is a top plan view of one of the pressure clamps used to connect elements of the platform adaptor to a support stand.

Each support stand in FIG. 1 has attached thereto a platform adapter 30 constructed according to a first preferred embodiment of this invention. This platform adapter 30 is best seen in FIGS. 2–5. It includes a support beam 31, a first pole clamp 33 pivotally attached to an inner end of the support beam by a connection means 34 and to the center pole 11 of the tripod support stand by a connection means 35, first and second support struts 36, 38 which are attached at their upper ends by a connection means 40 to a bracket 32 extending downwardly from the support beam 31, and second and third pole clamps 41, 43 which are pivotally attached to lower ends of the respective support struts 36, 38 by respective connection means 37, 39 for clamping attachment to the legs 14, 16 of the support stand. The clamps 33, 41, 43 are respectively attached to the center pole 11 and to the legs 14, 16 so as to cause the support beam 31 to be generally horizontally oriented. The support beam 31 can be a single element having a square or n-shaped cross section, or, as shown in FIGS. 1 and 2, a two-piece telescopic element having a circular cross section (telescoping two elements provide an enlarged support capability). Two platform adaptors appropriately attached to two spaced-apart tripod boat support stands can support a horizontally disposed platform element 50 adjacent the buttressed boat for workers who wish to stand at an elevated position along side the boat to work thereon and their equipment. The connection means 34, 35, 37, 39 and 40 are preferably in the form of bolts with cooperating wing nuts.

Figure 5:
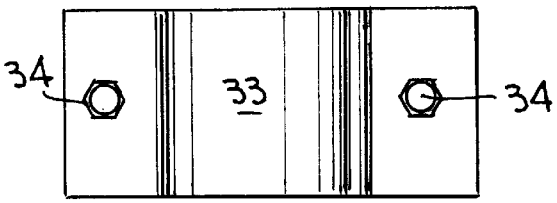
FIG. 5 is a side view of the pressure clamp of FIG. 4.
Figure 6:
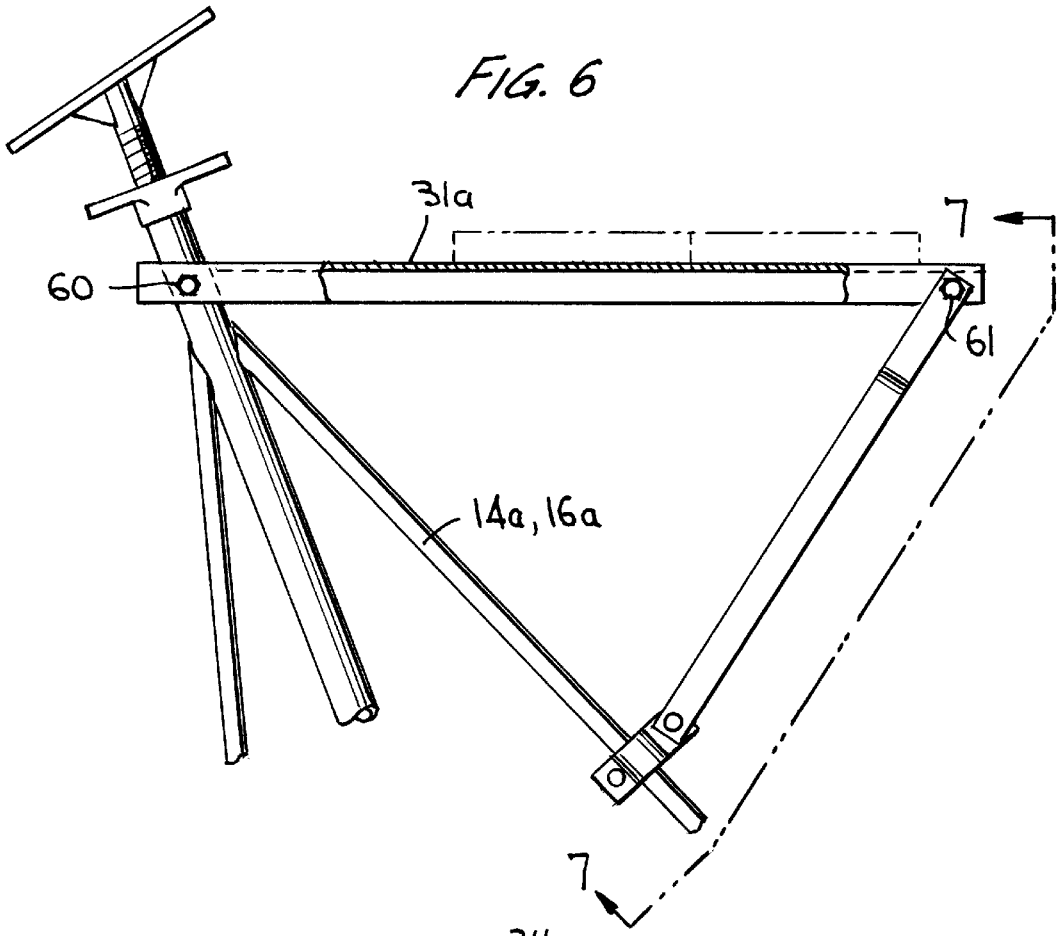
FIG. 6 shows a side view of a second preferred embodiment of platform adaptor according to the present invention.
Figure 7:
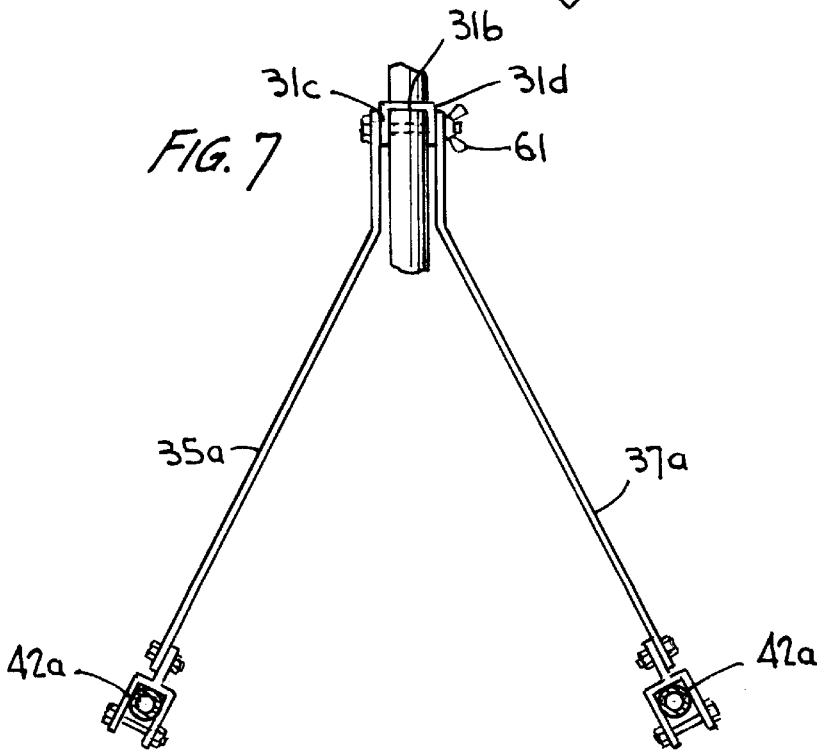
FIG. 7 is a view of the platform adaptor of FIG. 6 as seen along line 7—7.

FIGS. 5 and 6 show a second preferred embodiment of platform adaptor according to the present invention. In this embodiment, the support beam 31*a* is a single element having an n-shaped cross section formed by a center portion 31*b* extending between parallel flanges 31*c*, 31*d*, and instead of utilizing a clamp at its inner end for attachment to the center pole 11, the inner end is pivotally attached directly to the center pole 11. In this regard, the inner end of the support beam 31*a* comprises only the flanges 31*c*, 31*d* which extend along opposite sides of the center pole, and a connection means 60 pivotally connects the flanges to the center pole. In particular, the connection means comprises a bolt which is fitted through aligned holes in the flanges and aligned holes in the center pole to pivotally attach the support beam to the center pole, and a cooperating wing nut is threadingly engaged to the free end of the bolt. The support struts 35*a*, 37*a* are pivotally connected at their upper ends to the support beam by a common connection means 61 which includes a bolt that passes through a hole at the upper end of strut 35*a*, aligned holes in the flanges 31*c*, 31*d* and a hole at the upper end of strut 37*a*, and a wing nut is lockingly tightened to the free end of the bolt. The lower ends of struts 35*a*, 37*a* are connected to the legs 14*a*, 16*a* of the tripod support stand by clamps 40*a*, 42*a*.

Although two preferred embodiments of the invention have been shown and described, modifications therein can be made and still fall within the scope of the appended claims.

I claim:

1. A platform adaptor assembly for attachment to a support stand having a center pole and first, second and third support legs, said platform adaptor supporting a platform element laterally of a supported object and comprising:

a support beam defining an inner end, a first pole clamp at said inner end for attachment to said center pole, first and second support struts attached at upper ends thereof to said support beam, and second and third pole clamps at lower ends of said support struts for respective attachment to said second and third support legs, such that said support beam can be horizontally oriented when said platform adaptor is connected to said support stand.

2. A platform adaptor according to claim 1, wherein said support beam comprises a single element.

3. A platform adaptor according to claims 2, wherein said support beam has a n-shaped cross section defined by a center portion extending between two parallel flange portions.

4. A platform adaptor according to claim 3, wherein said inner end of said support beam has no center portion such that said flange portions can extend along opposite sides of said center pole, and wherein said first attachment means comprises a bolt which extends through a hole in said first flange portion, aligned holes in said center pole, and an aligned hole in said second flange portion, and a wing nut.

5. A support and platform assembly for supporting an elongated object and for providing a platform laterally thereof for people and equipment, said assembly comprising:

first and second spaced-apart support stands positioned laterally of said object, each support stand comprising a center pole, an abutment element located at an upper end of said center pole, and first, second and third legs connected to said center pole for positioning said center pole relative to said object, a platform adaptor connecting each of said first and second support stands, each platform adaptor comprising a support beam defining an inner end, a first attachment means for attaching said inner end of said support beam to said center pole, first and second support struts attached at upper ends thereof to said support beam, and second and third attachment means for attaching respective lower ends of said support struts to said second and third legs, such that said support beam can be generally horizontally oriented when said support beam is attached to said center pole, and a platform element spanning said support beams for supporting people and equipment laterally of said object.

6. The combination of a support stand and a platform adaptor connected to the support stand for supporting a platform element along a side of an object to be supported, said support stand including a center pole mounting an abutment element, and first, second and third legs connected to the center pole to position said center pole relative to said object to be supported, and said platform adaptor including a support beam defining an inner end, a first attachment means for attaching said inner end of said support beam to said center pole, first and second support struts attached at upper ends thereof to said support beam, and second and third attachment means for attaching respective lower ends of said support struts to said second and third legs, such that said support beam can be generally horizontally oriented when said support beam is attached to said center pole.

7. The combination of claim 6, wherein said first attachment means comprises a clamp pivotally attached to said inner end of said support beam.

8. The combination of claim 7, wherein said second and third attachment means comprise clamps respectively pivotally attached to lower ends of said first and second support struts.

9. The combination of claim 6, wherein said support stand includes spacer elements extending between said first, second and third legs and a lower end of said center pole.

10. The combination of claim 6, wherein said first leg is shorter in length than said second and third legs.

11. The combination of claim 6, wherein said support stand includes an adjustment collar for adjusting the positioning of said abutment element relative to said center pole and moving said abutment element against said object to be supported.

12. The combination of claim 6, wherein said center pole includes aligned holes therein, wherein said support beam includes parallel first and second flange portions that extend along opposite sides of said center pole, and wherein said first attachment means comprises a bolt and wing nut, said bolt extending through a hole in said first flange portion, through said aligned holes in said center pole, and a hole in said second flange portion.

13. The combination of claim 12, wherein said wing nut is threadingly engaged with a free end of said bolt.

14. The combination of claim 6, wherein said object is a boat.

* * * * *